US011020301B2

(12) United States Patent
Messerschmidt

(10) Patent No.: US 11,020,301 B2
(45) Date of Patent: Jun. 1, 2021

(54) SUPPORT APPARATUS

(71) Applicant: Nancy Jo Messerschmidt, Colorado Springs, CO (US)

(72) Inventor: Nancy Jo Messerschmidt, Colorado Springs, CO (US)

( * ) Notice: Subject to any disclaimer, the term of this patent is extended or adjusted under 35 U.S.C. 154(b) by 213 days.

(21) Appl. No.: 16/139,017

(22) Filed: Sep. 22, 2018

(65) Prior Publication Data

US 2019/0091084 A1 Mar. 28, 2019

Related U.S. Application Data

(60) Provisional application No. 62/562,429, filed on Sep. 23, 2017.

(51) Int. Cl.
*A61G 7/10* (2006.01)

(52) U.S. Cl.
CPC ..... *A61G 7/1023* (2013.01); *A61G 7/1026* (2013.01)

(58) Field of Classification Search
CPC ..... A61G 7/1023; A61G 7/1026; A61G 2200/32; A61G 2200/34; A61G 1/013; A61G 1/01
See application file for complete search history.

(56) References Cited

U.S. PATENT DOCUMENTS

| | | | | |
|---|---|---|---|---|
| 2,788,530 | A * | 4/1957 | Ferguson | A61G 1/01 5/628 |
| 4,723,327 | A * | 2/1988 | Smith | A61G 7/1026 294/140 |
| 8,701,225 | B1 * | 4/2014 | Latiff | A61G 7/1073 5/81.1 T |
| 2013/0116604 | A1 * | 5/2013 | Morilla | A61G 7/1015 601/33 |
| 2016/0242973 | A1 * | 8/2016 | Delaney | A61G 1/01 |

* cited by examiner

*Primary Examiner* — Eric J Kurilla
*Assistant Examiner* — James T Coble
(74) *Attorney, Agent, or Firm* — Roger A. Jackson

(57) ABSTRACT

The present invention is a support apparatus for an attendant manually transporting an individual from a first rest surface to a second rest surface, the support apparatus including a flexible planar element with a thickness dimension, the flexible planar element having a first end portion and an opposing second end portion, and a first side margin portion and an opposing second side margin portion, that all combine to form a peripheral portion of the flexible planar element. Further included is a flexible annular beam that is disposed on the peripheral portion, the beam having a short beam dimension thicker than the flexible planar element thickness dimension, wherein operationally the beam helps give a degree of stiffness to the flexible planar element and helps to provide a grasping handhold for the attendant along the peripheral portion.

11 Claims, 6 Drawing Sheets

SUPPORT APPARATUS

RELATED PATENT APPLICATION

This application claims the benefit of U.S. provisional patent application Ser. No. 62/562,429 filed on Sep. 23, 2017 by Nancy Jo Messerschmidt of Colorado Springs, Colo., U.S.

FIELD OF THE INVENTION

The present invention generally relates to a support apparatus that manually suspends and can move an individual from a first rest surface to a second rest surface. More particularly, the present invention discloses that the support apparatus as a planar element uses selectively graspable areas for an attendant to more easily suspend and possibly move the individual while providing a high strength, comfortable, and dry absorbent support apparatus.

DESCRIPTION OF THE RELATED ART

Looking at the prior art in the individual support apparatus arts in U.S. Pat. No. 5,214,813 to Gastle, et al. disclosed is a patient support device comprising a flexible support means, the support means having a pair of ends each of which includes a pair of hand holds, the hand holds being formed by cut outs in each corner of the support means, each of the cutouts forming a flap that engages the palm of the user's hand when lifting a patient. Further in Gastle '813, in each of the cut outs being aligned with a respective cutout so that, during use, the hand holds may be nested together to form an integral handle with overlapping flaps, see FIG. 6b, wherein the support means being formed of reinforced sheet material having sufficient rigidity to enable the integral handle to resist collapse, the support means being dimensioned to position the hand holds above a floor surface in order to minimize discomfort experienced by a user when lifting a patient. The novelty in Gastle '813 is in the fold over flaps in the hand holds, again see FIG. 6b.

Continuing, in the individual support apparatus arts in U.S. Pat. No. 2,835,902 to Fash, disclosed is a lifting sheet formed of a sheet of fabric substantially rectangular in plan view and folded upon itself to provide confronting layers with the edges of the layers over-lapping, stitches securing the over-lapping edges together, the folded sheet having an integral seat and a back, the back having parallel extending slits formed therein in a direction from transverse edges thereof and providing together with back an elongated arm sleeve extending along the transverse edge of the back and opening through said slits from the opposite side edges of the back. Also in Fash, the sheet on the side edge portions of the seat providing there between an arm sleeve extending toward the forward edge portion of the seat, and a hand strap formed in each of the side edge portions of the seat at the forward end of the last named arm sleeve, see Page 1 lines 59-71 and Page 2 lines 1-2. The novelty in Fash is in the double back layer of material.

Next, in the individual support prior art area, in U.S. Pat. No. 8,701,225 to Latiff, disclosed is an under pad comprising: a top layer; an absorbent layer disposed adjacent the top layer; a non-porous waterproof bottom layer disposed adjacent the absorbent layer; at least two handles on opposite sides of the under pad; a handle opening defined by each of the at least two handles; an annular foam layer disposed below the absorbent layer and circumscribing the handle opening. The novelty in Latiff is in the annular foam layer.

Continuing, in the individual support area in U.S. Pat. No. 5,333,335 to Gastle, et al. disclosed a patient support device comprising a flexible support means, the support means having a pair of ends each of which includes a pair of hand holds, the hand holds being formed by an aperture which is dimensioned to receive the palm of a user's hand when lifting a patient and flap means hinged to one edge of the aperture permitting the flap means to engage the palm of the user's hand when lifting a patient. In Gastle '335, each of the hand holds being aligned with a respective hand hold and the support means having a sufficient width so that, during use, the support means may be wrapped around a patient and the flap means may be nested together to form an integral handle, the support means being formed of reinforced sheet material having sufficient rigidity to enable the integral handle to resist collapse, the support means being dimensioned to position said hand holds above a floor surface in order to minimize discomfort experienced by a user when lifting a patient. In Gastle '335 the novelty is in the sheet rigidity in the handle.

Further, in the individual support prior art in U.S. Pat. No. 4,723,327 to Smith, disclosed is a patient moving device comprising a sheet of fabric material having a perimeter edge with multiple corners, an elongated continuous handle strap of a known width positioned movably around the perimeter edge of the sheet, a means for restricting movement of the handle strap to the sheet, loops adjustably positioned at the corners of the sheet, means for automatically adjusting sizes of the loops relative each other. The novelty in Smith is in the perimeter reinforcement.

The above references indicate the current state of the art in patient mover/incontinence pad arts, wherein Gastle '813 has handle fold over flaps, Fash has a double back layer, Latiff has a reinforced margin (see FIG. 6) and an annular foam layer also at the margin, Gastle '335 has reinforced sheet handle rigidity, and Smith has a perimeter reinforcement handle. What is needed is a support apparatus that has the handle having various types of reinforcement for strength and a unique layering structure of the sheet pad material for strength, absorbency, and dryness.

SUMMARY OF INVENTION

Broadly, the present invention is a support apparatus for an attendant manually transporting an individual from a first rest surface to a second rest surface, the support apparatus including a flexible planar element with a thickness dimension, the flexible planar element having a first end portion and an opposing second end portion with a longitudinal axis spanning therebetween, the flexible planar element further having a first side margin portion and an opposing second side margin portion with a margin axis, wherein the margin axis and the longitudinal axis are substantially perpendicular to one another, wherein the first and second end portions and the first and second side margin portions all combined forming a peripheral portion of the flexible planar element.

Further included in the support apparatus is a flexible annular beam having a beam long axis and a substantially perpendicularly positioned beam short axis, the beam is disposed on the peripheral portion, the beam having a short beam dimension along a portion of the beam short axis that is greater than the flexible planar thickness dimension, wherein operationally the beam helps give a degree of stiffness to the flexible planar element and helps to provide a grasping handhold for the attendant along the peripheral portion.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
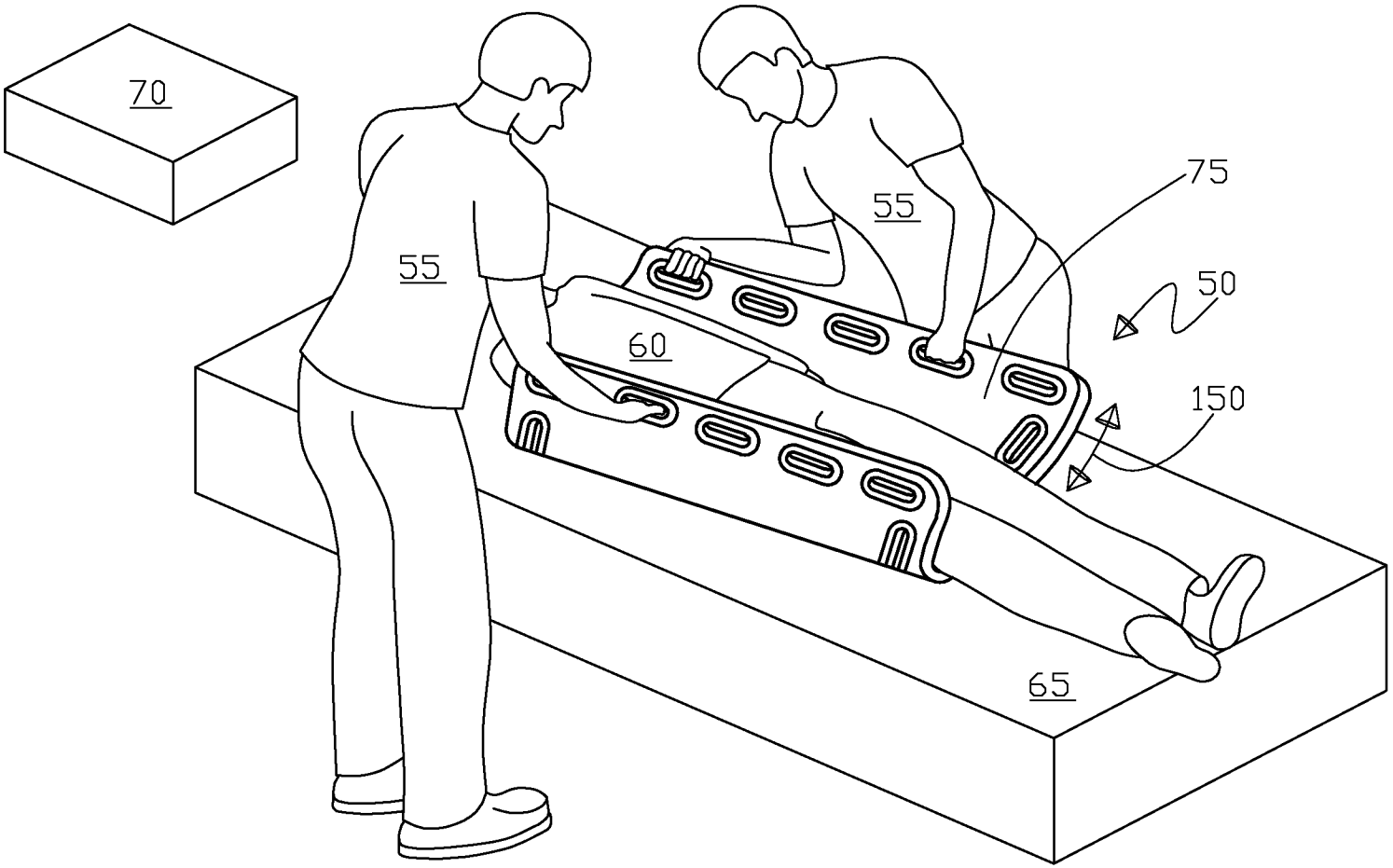
FIG. 1 shows an upper perspective use view of the support apparatus being used to suspend an individual over a first rest surface by two attendants for possible moving over to a second rest surface, wherein the attendants are using apertures for handholds on the support apparatus.

50 Support apparatus
55 Attendant
60 Individual
65 First rest surface
70 Second rest surface
75 Flexible planar element
80 Thickness dimension
85 First end portion
90 Second end portion
95 Longitudinal axis
100 First side margin
105 Second side margin
110 Margin axis
115 Perpendicular position of the margin axis 110 and the longitudinal axis 95
120 Peripheral portion of the flexible planar element 75
125 Flexible annular beam
130 Beam long axis
135 Beam short axis
140 Perpendicular position of the beam long axis 130 to the beam short axis 135
145 Short beam dimension
150 Degree of stiffness
155 Gasping handhold
160 Flexible annular beam 125 being wrapped about the beam long axis 130
165 Encompassing layer of the flexible annular beam 125 about the beam long axis 130 for the flexible planar element 75
170 Textured coarse surface
175 Peaks of the textured coarse surface 170
180 Valleys of the textured coarse surface
185 Five layer construction material
190 Bamboo fabric
195 Polyester
200 Fabric absorption/evaporation mat branded as COZY-MAT
205 Nylon structure
210 Woven reinforced fabric
215 Six layer construction material
220 Non woven super absorption fiber
225 Urethane
230 Aperture
235 Aperture margin
240 Reinforcing panel
245 Tensile strength capability
250 Flexible aperture 230 beam
255 Encompassing of the of the flexible aperture 230 beam 250

DETAILED DESCRIPTION

With initial reference to FIG. 1, shown is an upper perspective use view of the support apparatus 50 being used to suspend an individual 60 over a first rest surface 65 by two attendants 55 for possible moving over to a second rest surface 70, wherein the attendants 55 are using apertures 230 for attendant 55 handholds 155 on the support apparatus 50.

Figure 2:
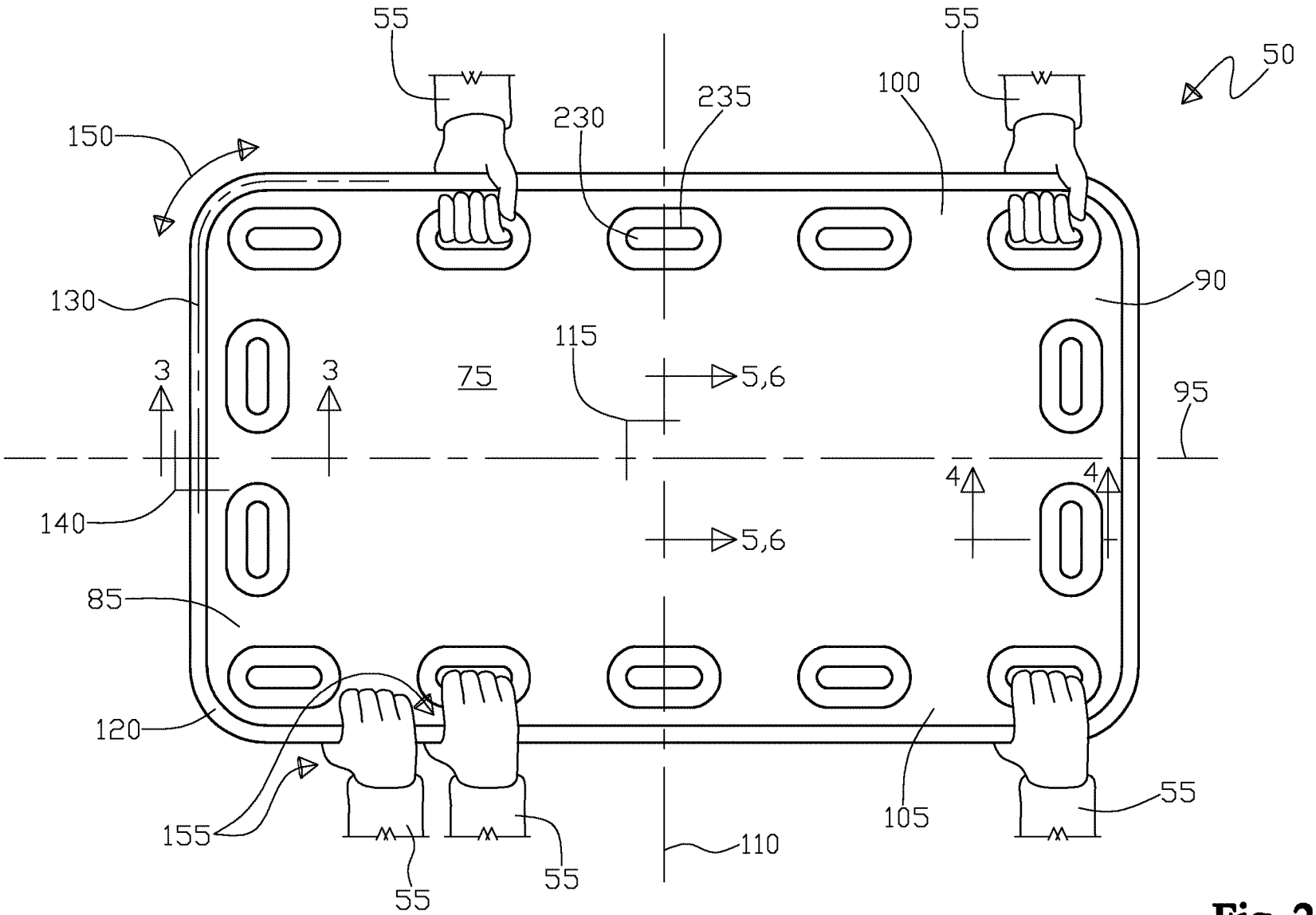
FIG. 2 shows a flat plan view of the support apparatus that includes the attendants using the aperture, further shown are a flexible planar element, first and second end portions, first and second side margins, a peripheral portion, along with a longitudinal axis and a margin axis, plus a flexible annular beam with a beam long axis.

Next, FIG. 2 shows a flat plan view of the support apparatus 50 that includes the attendants 55 using the aperture 230, further shown is a flexible planar element 75, first 85 and second 90 end portions, first 100 and second 105 side margins, a peripheral portion 120, along with a longitudinal axis 95 and a margin axis 110, plus a flexible annular beam 125 with a beam long axis 130.

Figure 3:
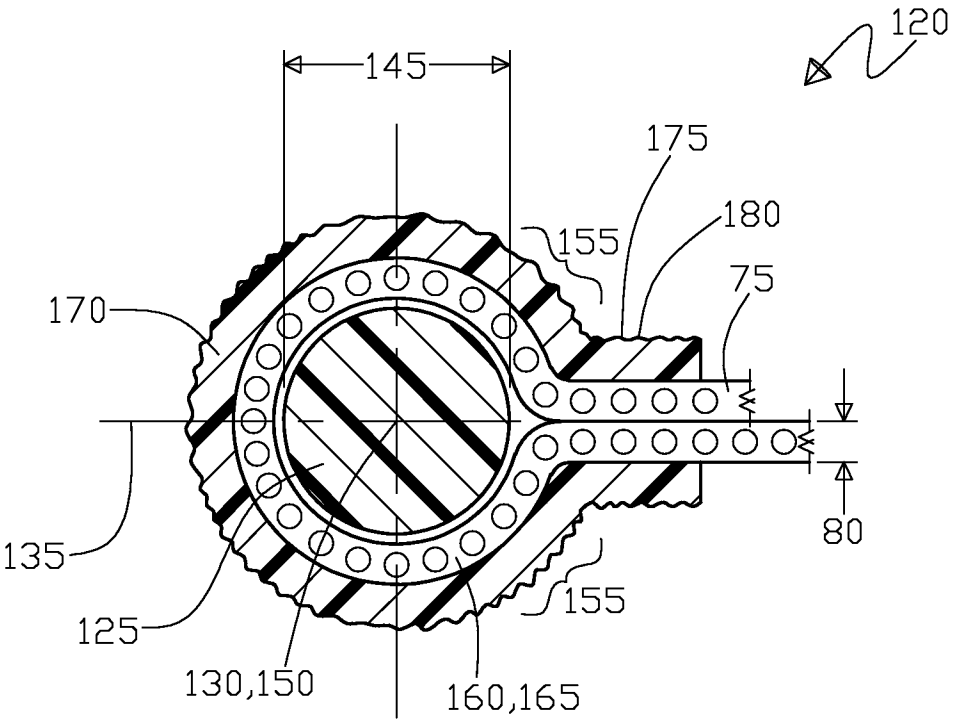
FIG. 3 shows cross section 3-3 from FIG. 2 being in particular the flexible planar element and peripheral portion with the flexible annular beam, including a textured coarse surface all in cross section to show how the peripheral portion is reinforced.

Continuing, FIG. 3 shows cross section 3-3 from FIG. 2 being in particular the flexible planar element 75 and peripheral portion 120 with the flexible annular beam 125, including a textured coarse surface 170 all in cross section to show how the peripheral portion 120 of the flexible planar element 75 is reinforced.

Figure 4:
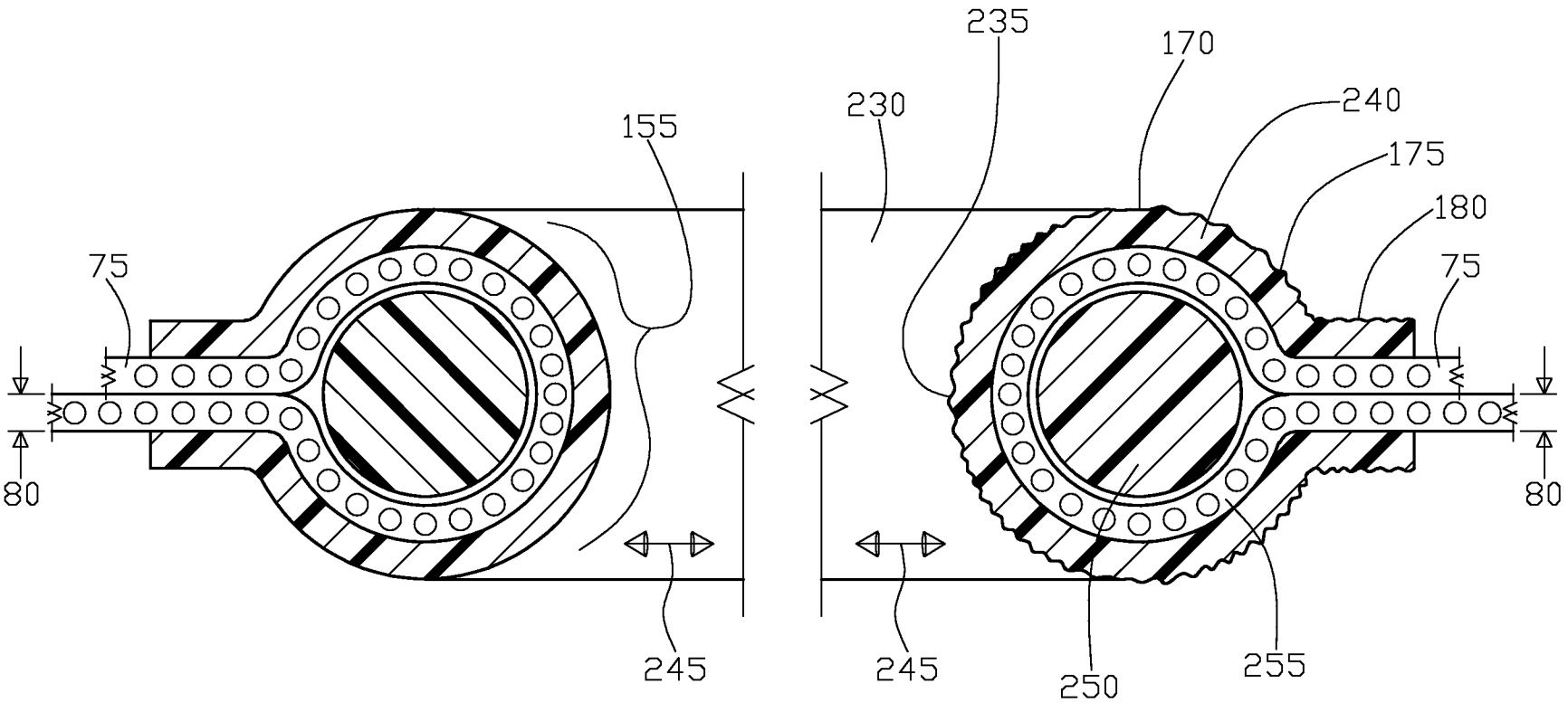
FIG. 4 shows cross section 4-4 from FIG. 2 being in particular the flexible planar element and aperture with an aperture margin also with a flexible aperture beam, including a textured coarse surface all in cross section to show how the aperture is reinforced.

Further, FIG. 4 shows cross section 4-4 from FIG. 2 being in particular the flexible planar element 75 and aperture 230 with an aperture margin 235 also with a flexible aperture beam 250, including a textured coarse surface 170 all in cross section to show how the aperture 230 is reinforced within the flexible planar element 75.

Figure 5:
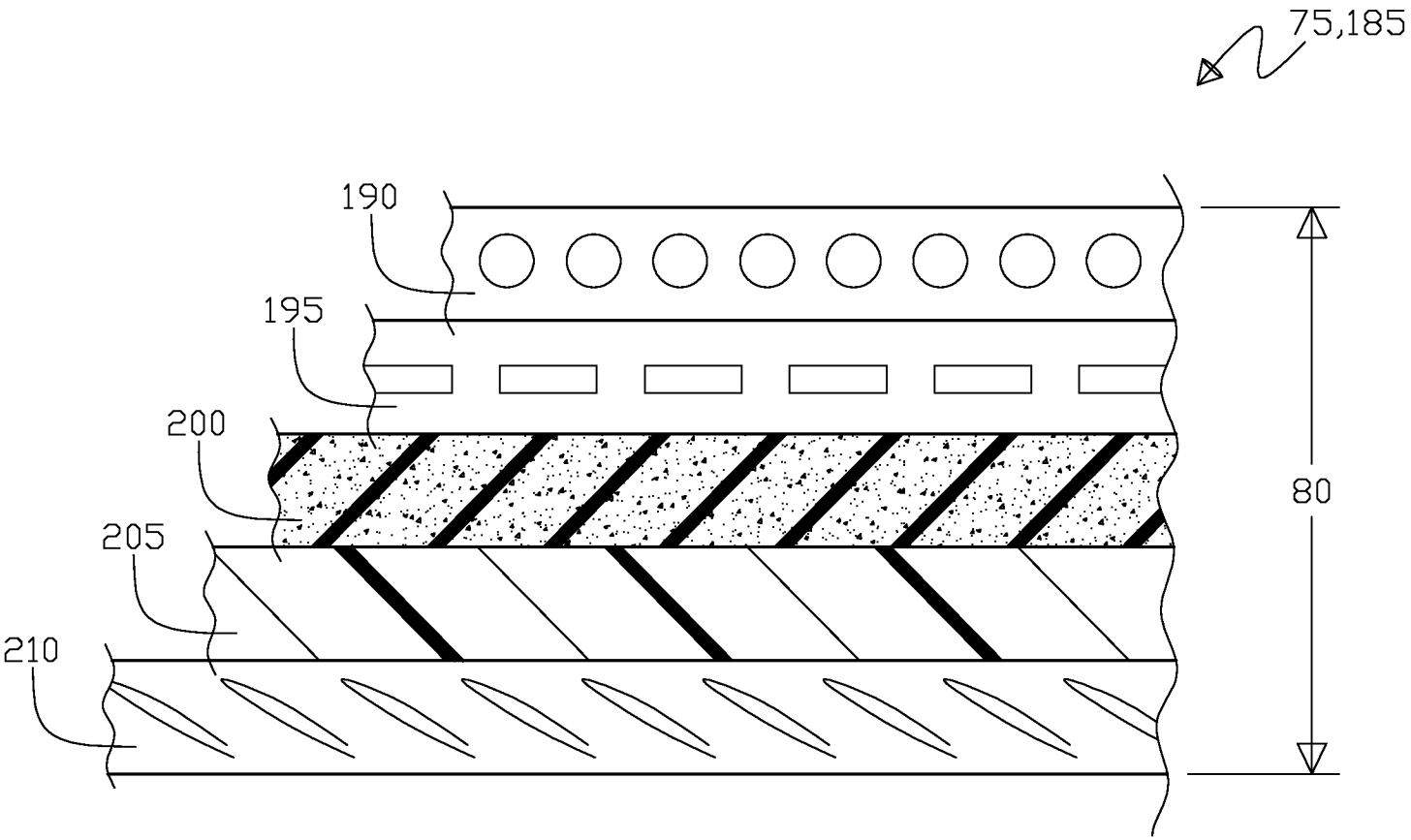
FIG. 5 shows a cross section of the five layer flexible planar element that includes a bamboo fabric, a polyester fabric, a fabric absorption & evaporation layer, a nylon structure, and a woven reinforced fabric all disposed within a thickness dimension of the flexible planar element.

Yet further, FIG. 5 shows a cross section of the five layer 185 flexible planar element 75 that includes a bamboo fabric 190, a polyester fabric 195, a fabric absorption & evaporation layer 200, a nylon structure 205, and a woven reinforced fabric 210 all disposed within a thickness dimension 80 of the flexible planar element 75.

Figure 6:
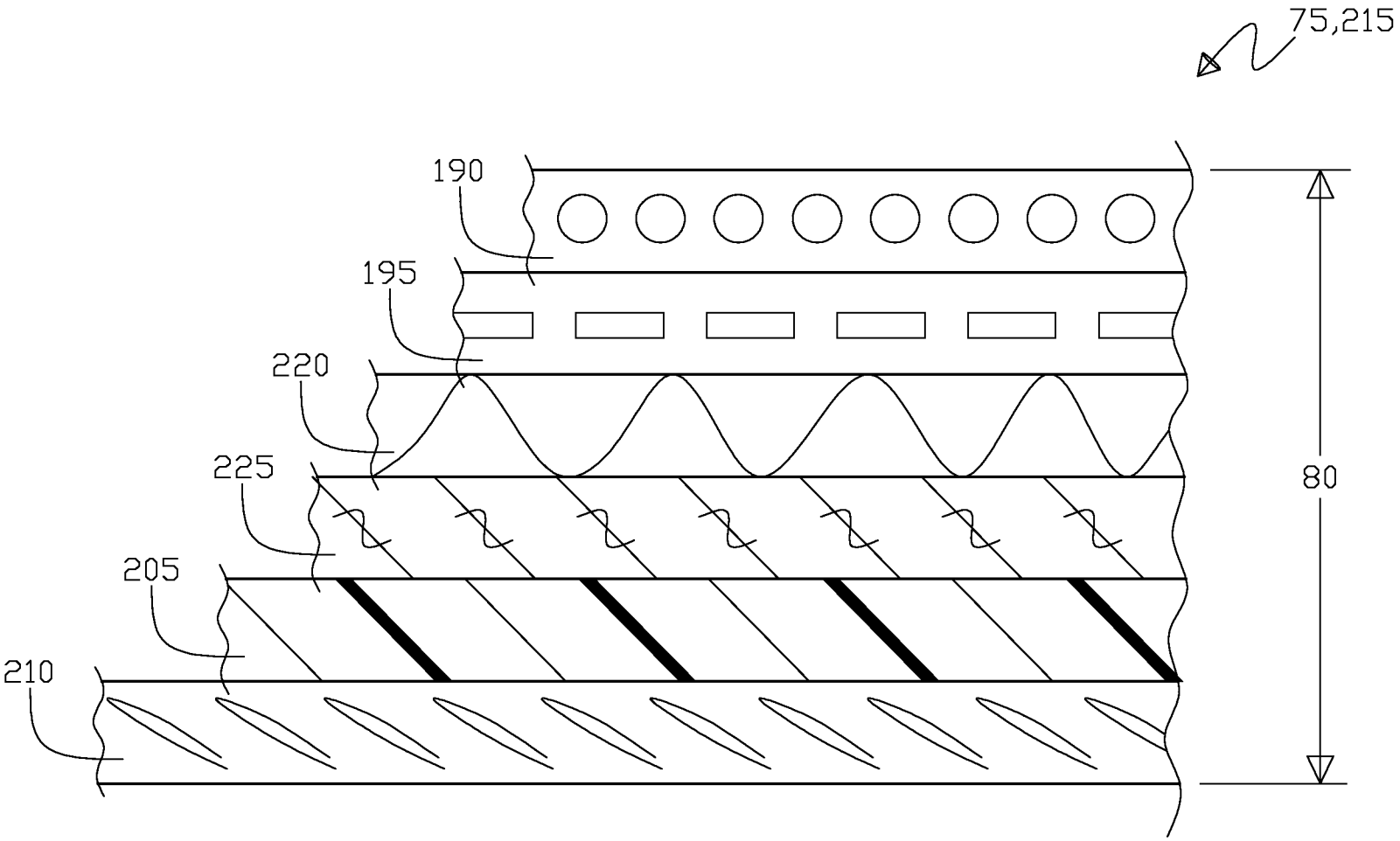
FIG. 6 shows a cross section of the six layer flexible planar element that includes a bamboo fabric, a polyester fabric, a non woven super absorption fiber, urethane, the nylon structure, and the woven reinforced fabric all disposed within a thickness dimension of the flexible planar element.

Continuing, FIG. 6 shows a cross section of the six layer 215 flexible planar element 75 that includes a bamboo fabric 190, a polyester fabric 195, a non woven super absorption fiber 220, urethane 225, the nylon structure 205, and the woven reinforced fabric 210 all disposed within a thickness dimension 80 of the flexible planar element 75.

Broadly, the present invention is the support apparatus 50 for the attendant 55 manually transporting the individual 60 from the first rest surface 65 to the second rest surface 70, or could be for the attendant 55 to manually just suspend the individual 60 for other purposes such as changing bedding and the like, as best shown in FIG. 1. The support apparatus 50 includes a flexible planar element 75 with the thickness dimension 80, the flexible planar element 75 having the first end portion 85 and the opposing second end portion 90 with the longitudinal axis spanning therebetween 95, the flexible planar element 75 further having the first side margin portion 100 and the opposing second side margin portion 105 with the margin axis 110, as best shown in FIG. 2. Wherein the margin axis 110 and the longitudinal axis 95 are substantially perpendicular 115 to one another, plus wherein the first 85 and second 90 end portions and the first 100 and second 105 side margin portions are all combined forming the peripheral portion 120 of the flexible planar element 75, again see FIG. 2.

Further included in the support apparatus 50 is the flexible annular beam 125 having the beam long axis 130 and a substantially perpendicularly positioned 140 beam short axis 135, the beam 125 is disposed on the peripheral portion 120, the beam 125 having a short beam dimension 145 along a portion of the beam short axis 135 that is greater than the flexible planar element 75 thickness dimension 80, see FIGS. 2 and 3. Wherein operationally, the beam 125 helps give a degree of stiffness 150 to the flexible planar element 75 and helps to provide a grasping handhold 155 for the attendant 55 along the peripheral portion 120, again see FIGS. 2 and 3.

As an option for the support apparatus 50, the flexible annular beam 125 can be further constructed of being wrapped 160 about the beam 125 long axis 130 in an encompassing layer 165 of the flexible planar element 75 from the peripheral portion 120 to further add to an attachment strength as between the beam 125 and the flexible planar element 75, as best shown in FIG. 3, also see FIG. 2. Another option for the support apparatus 50, is wherein the flexible beam 125 can further comprise the textured course surface 170 with alternate peaks 175 and valleys 180 as the outer barrier sheet that covers the encompassing layer 165, wherein operationally the outer barrier sheet adds a high friction grasping 155 surface for the attendant 55, see FIG. 3 and also FIGS. 1 and 2.

A further option for the support apparatus 50, is wherein the flexible planar element 75 further comprises the five layer construction material 185 that is selected from the group consisting essentially of bamboo fabric 190, polyester 195, woven absorption/evaporation fabric 200, nylon structure 205, and woven reinforced fabric 210, as shown in FIG. 5. Yet another option for the support apparatus 50 wherein the flexible planar element 75 can further comprise the six layer construction material 215 that is selected from the group consisting essentially of bamboo fabric 190, polyester 195, non-woven super absorption fiber 220, urethane 225, nylon structure 205, and woven reinforced fabric 210, as shown in FIG. 6.

Broadly, the present invention is the support apparatus 50 for the attendant 55 manually transporting the individual 60 from the first rest surface 65 to the second rest surface 70, or could be for the attendant 55 to manually just suspend the individual 60 for other purposes such as changing bedding and the like, as best shown in FIG. 1. The support apparatus 50 includes a flexible planar element 75 with the thickness dimension 80, the flexible planar element 75 having the first end portion 85 and the opposing second end portion 90 with the longitudinal axis spanning therebetween 95, the flexible planar element 75 further having the first side margin portion 100 and the opposing second side margin portion 105 with the margin axis 110, as best shown in FIG. 2. Wherein the margin axis 110 and the longitudinal axis 95 are substantially perpendicular 115 to one another, plus wherein the first 85 and second 90 end portions and the first 100 and second 105 side margin portions are all combined forming the peripheral portion 120 of the flexible planar element 75, again see FIG. 2.

Also included in the support apparatus 50 is the aperture 230 disposed therethrough the peripheral portion 120, with the aperture 230 having an aperture margin portion 235 that has a reinforcing panel 240 affixed to the aperture margin 235, wherein operationally the panel 240 adds tensile strength capability 245 to the aperture margin 235 to facilitate the attendant 55 manually grasping 155 therethrough the aperture 230, see in particular FIG. 4, also see FIGS. 1 and 2.

Further included in the support apparatus 50 is the flexible annular beam 125 having the beam long axis 130 and a substantially perpendicularly positioned 140 beam short axis 135, the beam 125 is disposed on the peripheral portion 120, the beam 125 having a short beam dimension 145 along a portion of the beam short axis 135 that is greater than the flexible planar element 75 thickness dimension 80, wherein operationally the beam 125 helps give a degree of stiffness 150 to the flexible planar element 75 and helps to provide a grasping handhold 155 for the attendant 55 along the peripheral portion 120, see FIGS. 2 and 3.

Also optionally on the support apparatus 50 the aperture 230 reinforcing panel 240 can further comprise the flexible aperture beam 250 that is fixably wrapped in an encompassing layer 255 by the flexible planar element 75 to operationally further add tensile strength 245 to the aperture 230 margin 235, see FIG. 4 and also FIG. 2. In addition optionally for the support apparatus 50 wherein the flexible aperture beam 250 can further comprise a reinforcing panel 240 affixed to a portion of the flexible planar element 75 that comprises the aperture 230 margin 235, wherein the reinforcing panel 240 has a textured course outer surface 170 with alternate peaks 175 and valleys 180, wherein operationally the reinforcing panel 240 adds a high friction grasping 155 surface for the attendant 55, see in particular FIG. 4 and also FIG. 2.

CONCLUSION

Accordingly, the present invention of the support apparatus has been described with some degree of particularity directed to the embodiments of the present invention. It should be appreciated, though; that the present invention is defined by the following claims construed in light of the prior art so modifications of the changes may be made to the exemplary embodiments of the present invention without departing from the inventive concepts contained therein.

The invention claimed is:

1. A support apparatus for an attendant manually transporting an individual from a first rest surface to a second rest surface, said support apparatus comprising:

(a) a flexible planar element with a thickness dimension, said flexible planar element having a first end portion and an opposing second end portion with a longitudinal axis spanning therebetween, said flexible planar element further having a first side margin portion and an opposing second side margin portion with a margin axis, wherein said margin axis and said longitudinal axis are substantially perpendicular to one another, wherein said first and second end portions and said first and second side margin portions are all combined forming a peripheral portion of said flexible planar element, wherein said flexible planar element further comprises a five layer construction material that is selected from the group consisting essentially of bamboo fabric, polyester, woven absorption/evaporation fabric, nylon structure, and woven reinforced fabric; and (b) a flexible annular beam having a beam long axis and a substantially perpendicularly positioned beam short axis, said beam is disposed on said peripheral portion, said beam having a short beam dimension along a portion of said beam short axis that is greater than said flexible planar element thickness dimension, wherein operationally said beam helps give a degree of stiffness to said flexible planar element and helps to provide a grasping handhold for the attendant along said peripheral portion.

2. A support apparatus according to claim 1 wherein said flexible annular beam is further constructed of being wrapped about said beam long axis in an encompassing layer of said flexible planar element from said peripheral portion to further add to an attachment strength as between said beam and said flexible planar element.

3. A support apparatus according to claim 2 wherein said flexible beam further comprises a textured course surface with alternate peaks and valleys outer barrier sheet that covers said encompassing layer, wherein operationally said outer barrier sheet adds a high friction grasping surface for the attendant.

4. A support apparatus according to claim 1 wherein said five layer flexible planar element further comprises a six layer construction material that is selected from the group consisting essentially of bamboo fabric, polyester, non-woven super absorption fiber, urethane, nylon structure, and woven reinforced fabric.

5. A support apparatus for an attendant manually transporting an individual from a first rest surface to a second rest surface, said support apparatus comprising:

(a) a flexible planar element with a thickness dimension, said flexible planar element having a first end portion and an opposing second end portion with a longitudinal axis spanning therebetween, said flexible planar element further having a first side margin portion and an opposing second side margin portion with a margin axis, wherein said margin axis and said longitudinal axis are substantially perpendicular to one another, wherein said first and second end portions and said first and second side margin portions are all combined forming a peripheral portion of said flexible planar element;

(b) an aperture disposed therethrough said peripheral portion, said aperture having an aperture margin portion that has a reinforcing panel affixed to said aperture margin, wherein operationally said panel adds tensile strength capability to said aperture margin to facilitate the attendant manually grasping therethrough said aperture; and (c) a flexible annular beam having a beam long axis and a substantially perpendicularly positioned beam short axis, said beam is disposed on said peripheral portion, said beam having a short beam dimension along a portion of said beam short axis that is greater than said flexible planar element thickness dimension, wherein operationally said beam helps give a degree of stiffness to said flexible planar element and helps to provide a grasping handhold for the attendant along said peripheral portion.

6. A support apparatus according to claim 5 wherein said flexible annular beam is further constructed of being wrapped about said beam long axis in an encompassing layer of said flexible planar element from said peripheral portion to further add to an attachment strength as between said beam and said flexible planar element.

7. A support apparatus according to claim 6 wherein said flexible annular beam further comprises a textured course surface with alternate peaks and valleys outer barrier sheet that covers said encompassing layer, wherein operationally said outer barrier sheet adds a high friction grasping surface for the attendant.

8. A support apparatus according to claim 5 wherein said flexible planar element further comprises a five layer construction material that is selected from the group consisting essentially of bamboo fabric, polyester, woven absorption/evaporation fabric, nylon structure, and woven reinforced fabric.

9. A support apparatus according to claim 5 wherein said flexible planar element further comprises a six layer construction material that is selected from the group consisting essentially of bamboo fabric, polyester, non-woven super absorption fiber, urethane, nylon structure, and woven reinforced fabric.

10. A support apparatus according to claim 5 wherein said aperture reinforcing panel further comprises a flexible aperture beam that is fixably wrapped in an encompassing layer by said flexible planar element to operationally further add tensile strength to said aperture margin.

11. A support apparatus according to claim 10 wherein said flexible aperture beam further comprises a reinforcing panel affixed to a portion of said flexible planar element that comprises said aperture margin, wherein said reinforcing panel has a textured course outer surface with alternate peaks and valleys, wherein operationally said reinforcing panel adds a high friction grasping surface for the attendant.

* * * * *